US005544777A

United States Patent [19]

Watson

[11] Patent Number: 5,544,777

[45] Date of Patent: Aug. 13, 1996

[54] STACKABLE PLASTIC CONTAINER WITH DRAIN SUMP AND PALLET AND METHOD OF MAKING THE SAME

[75] Inventor: Lowell G. Watson, Belleville, Canada

[73] Assignee: Greif Bros. Corporation, Delaware, Ohio

[21] Appl. No.: 68,603

[22] Filed: May 27, 1993

Related U.S. Application Data

[63] Continuation of Ser. No. 782,975, Oct. 21, 1991, abandoned, which is a continuation-in-part of Ser. No. 660,699, Feb. 25, 1991, abandoned.

[51] Int. Cl.[6] ..... B65D 19/00

[52] U.S. Cl. ..... 220/4.13; 220/1.5

[58] Field of Search ..... 220/660, 1.5, 4.12, 220/4.13, 625, 630, 636, 400, 401, 402, 470, 4.05, 628, 634, 4.21, 4.24; 206/509, 511

[56] References Cited

U.S. PATENT DOCUMENTS

| | | | |
|---|---|---|---|
| 313,077 | 3/1885 | Hudson . | |
| 3,162,331 | 12/1964 | Hutchins et al. | 220/1.5 X |
| 3,361,290 | 1/1968 | Matthews et al. | 220/4.21 X |
| 3,406,855 | 10/1968 | McKechnie | 220/1.5 |
| 3,797,691 | 3/1974 | Williams, Jr. | 220/1.5 |
| 3,840,141 | 10/1974 | Allom et al. | 220/628 |
| 3,952,904 | 4/1976 | Verlinden | 220/4.05 |
| 4,140,236 | 2/1979 | Uhlig et al. | 220/630 X |
| 4,247,357 | 1/1981 | Kontz . | |
| 4,413,737 | 11/1983 | Wind | 206/511 X |
| 4,609,120 | 9/1986 | Lauer et al. | 220/630 X |
| 4,648,521 | 3/1987 | Thomas et al. | 220/4.13 X |
| 4,883,188 | 11/1989 | Barth . | |
| 4,887,731 | 12/1989 | Pett et al. | 220/1.5 |
| 4,909,387 | 3/1990 | Schutz | 220/401 X |
| 5,044,502 | 9/1991 | Hale | 220/1.5 X |
| 5,048,705 | 9/1991 | Lynd et al. . | |

*Primary Examiner*—Steven M. Pollard

*Attorney, Agent, or Firm*—Kane, Dalsimer, Sullivan, Kurucz, Levy, Eisele and Richard, LLP

[57] ABSTRACT

A plastic container is formed with a body having an access hole on top and a pallet coupled to the bottom thereof. The body also includes a sloping bottom with a sump aligned with the access hole to allow, substantially, all the contents of the container to be removed without turning the body upside down with said pallet protecting the bottom, allowing the container to stand horizontally, and facilitating the stacking of said containers.

17 Claims, 9 Drawing Sheets

STACKABLE PLASTIC CONTAINER WITH DRAIN SUMP AND PALLET AND METHOD OF MAKING THE SAME

CROSS REFERENCE TO RELATED APPLICATION

This is a continuation of application Ser. No. 07/782,975 filed on Oct. 21, 1991, now abandoned, which is a continuation in part of U.S. application Ser. No. 660,699 filed Feb. 25, 1991, now abandoned.

BACKGROUND OF THE INVENTION

FIELD OF THE INVENTION

This invention relates to a unitary plastic container for shipping and storing various materials, and more specifically to a stackable plastic container for liquid materials, which container has a sloping bottom with a sump so that all the liquid can be pumped out efficiently, along with a plastic pallet coupled thereto.

DESCRIPTION OF THE PRIOR ART

Plastic containers are used frequently to ship and store various materials. These types of containers are preferred over metal containers because they are simpler and cheaper to make, easier to handle, and weigh less. Frequently, plastic containers are used to ship liquid materials used in agriculture, or the chemical industry which are highly concentrated and therefore, must be diluted. Since these liquids are very expensive, it is important that all the contents of the container be removed before the container is discarded or returned, to eliminate waste. One method of emptying completely the contents of a plastic container would be to turn the container upside down. However, this procedure is time-consuming and requires special equipment. Moreover, if the container contains hazardous materials, turning the container over may result in a spill, which is both uneconomical and undesirable.

Hence, there is a great need in the art for a plastic container which could be emptied efficiently. In addition it is desirable that such containers include a pallet to protect the lower portion of the container during shipping and storage which supports the container off the ground. It is further desirable that the design be stackable in nature for improved handling and storage.

OBJECTIONS AND SUMMARY OF THE INVENTION

In view of the above-mentioned disadvantages of the prior art, it is an objective of the present invention to provide a plastic container which can be efficiently emptied without turning it over and which includes a pallet coupled therewith to protect the lower design of the container during shipping and handling.

A yet further objective is to provide such a drainable container which includes a pallet along with interlocking members which allow for the stacking thereof.

It is a yet further object of the invention to provide for an efficient and economic production of the container pallet as for example through the process of blow molding.

Another objective of the invention is to provide a container which can be emptied efficiently using standard equipment having the foregoing features.

Other objectives and advantages of the invention shall become apparent from the following description of the invention. Briefly, a plastic container constructed in accordance with this invention consists of a somewhat rectangular plastic body having initially a straight then sloping sides, a top, a sloping bottom and at least one access hole provided on the top for filling and emptying the container, said hole being off-center. The bottom is formed with a sump which is vertically aligned with the access hole whereby as the container is emptied, all the liquid collects in the sump and is easily removed. A pallet, which may be for example manufactured by blow molding is added to lower or bottom end of the body for protection as well as to insure that the container stands upright or vertical when resting on a horizontal surface. In addition the top includes integral interlocking means which serve to interlock with the bottom portion of the pallet of the container stacked thereon.

BRIEF DESCRIPTION OF THE DRAWINGS

Thus by the present invention, its objects and advantages will be realized the description of which should be taken in conjunction with the drawings wherein.

DETAILED DESCRIPTION OF THE INVENTION

Figure 1:
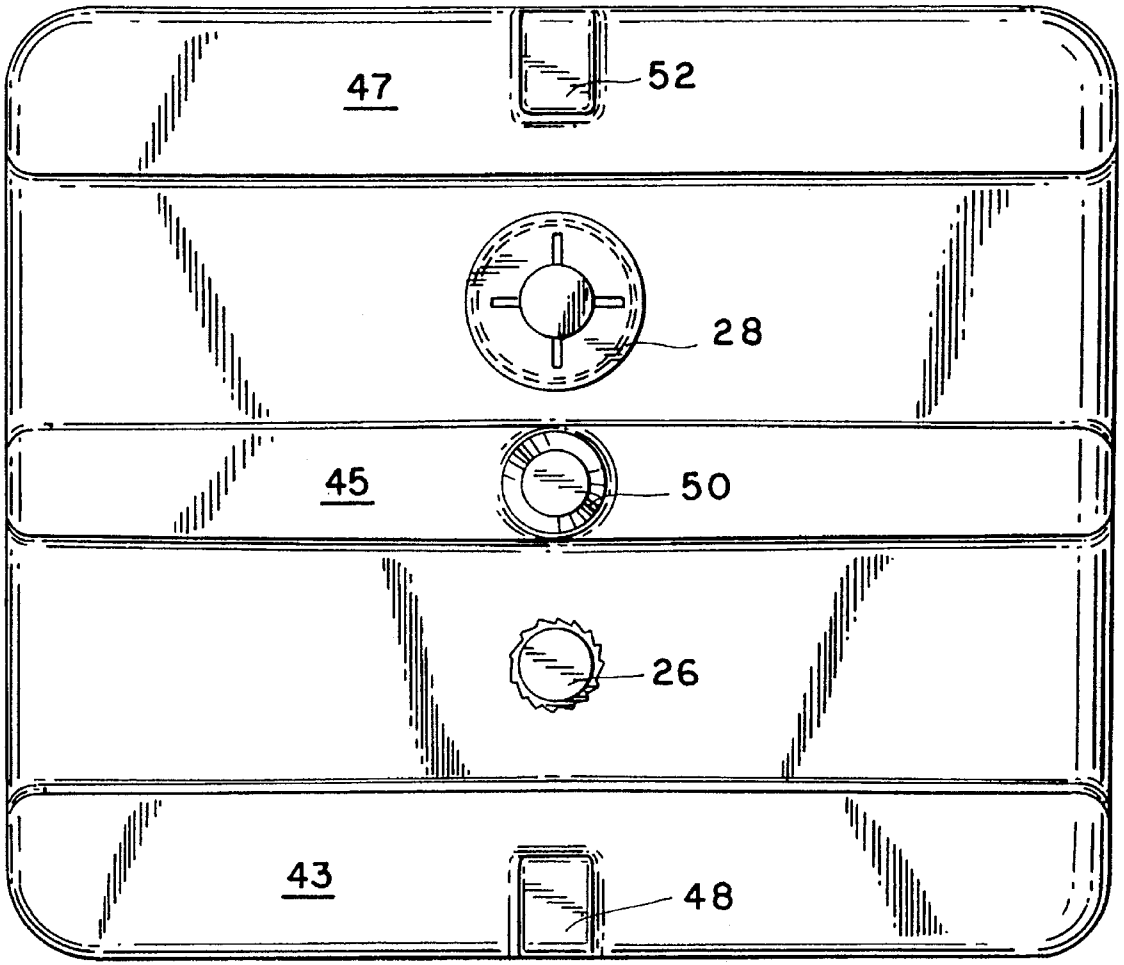
FIG. 1 is a top view of the container.
Figure 2:
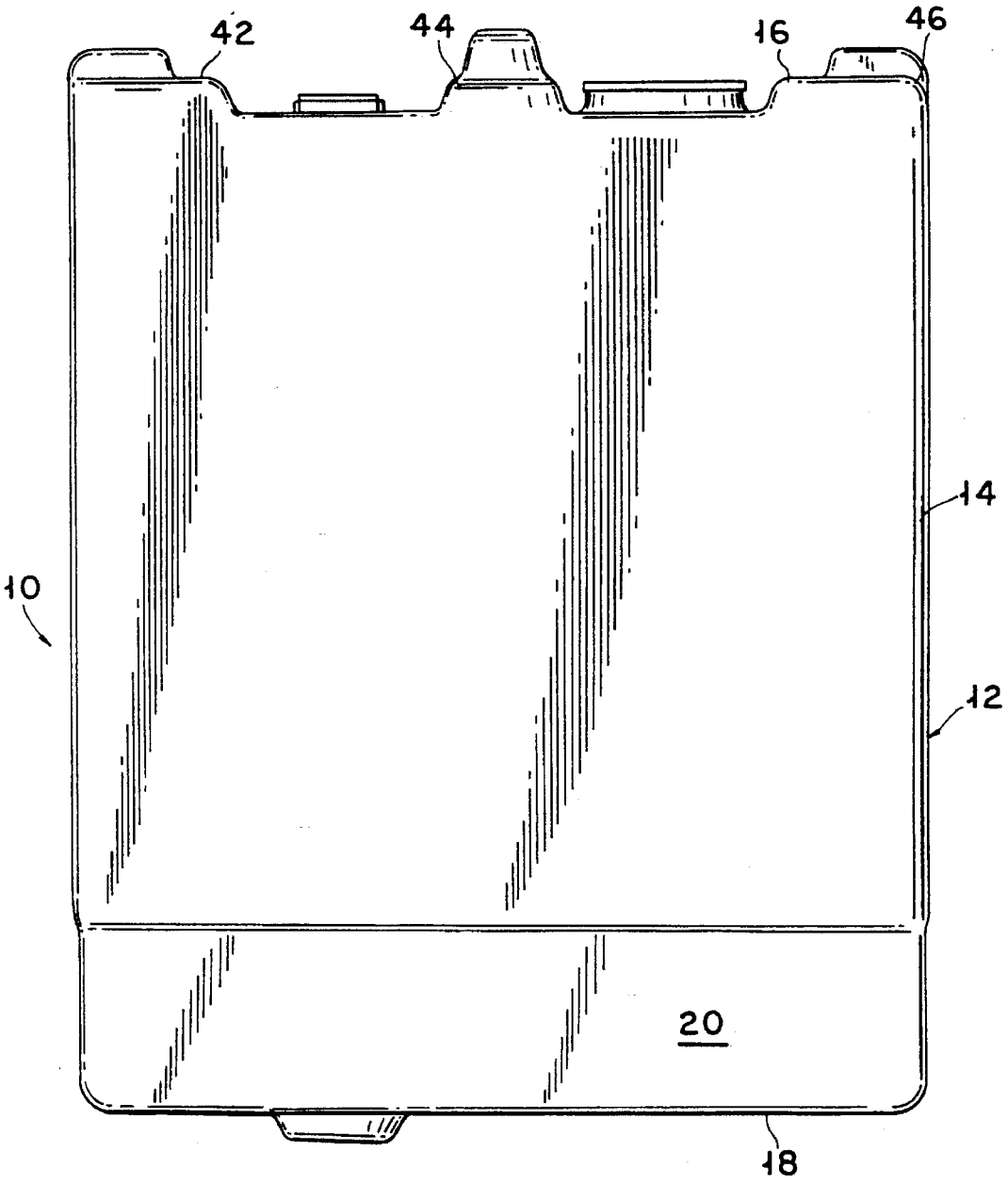
FIG. 2 is a right side view of the container.
Figure 3:
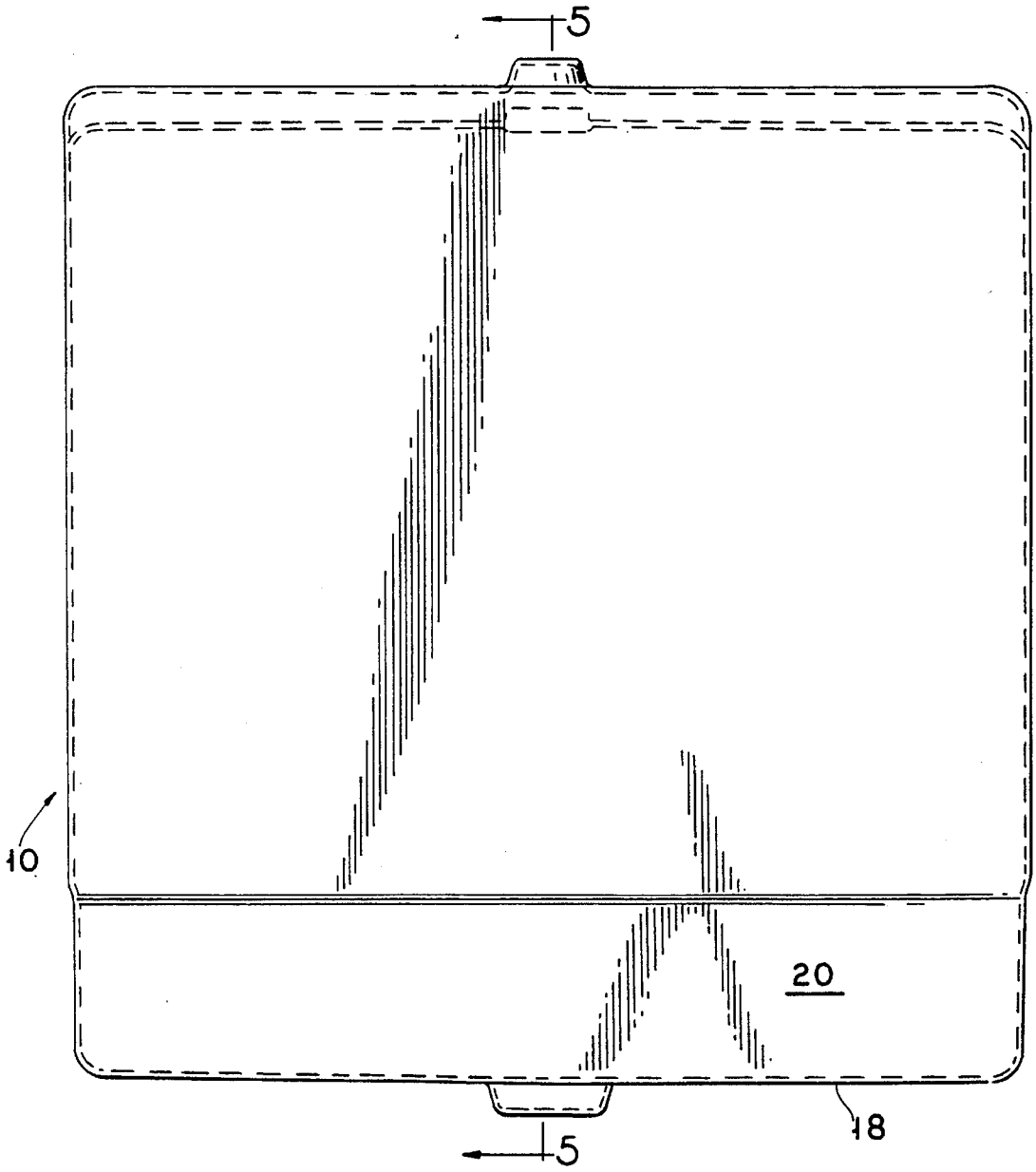
FIG. 3 is a front view of the container.
Figure 4:
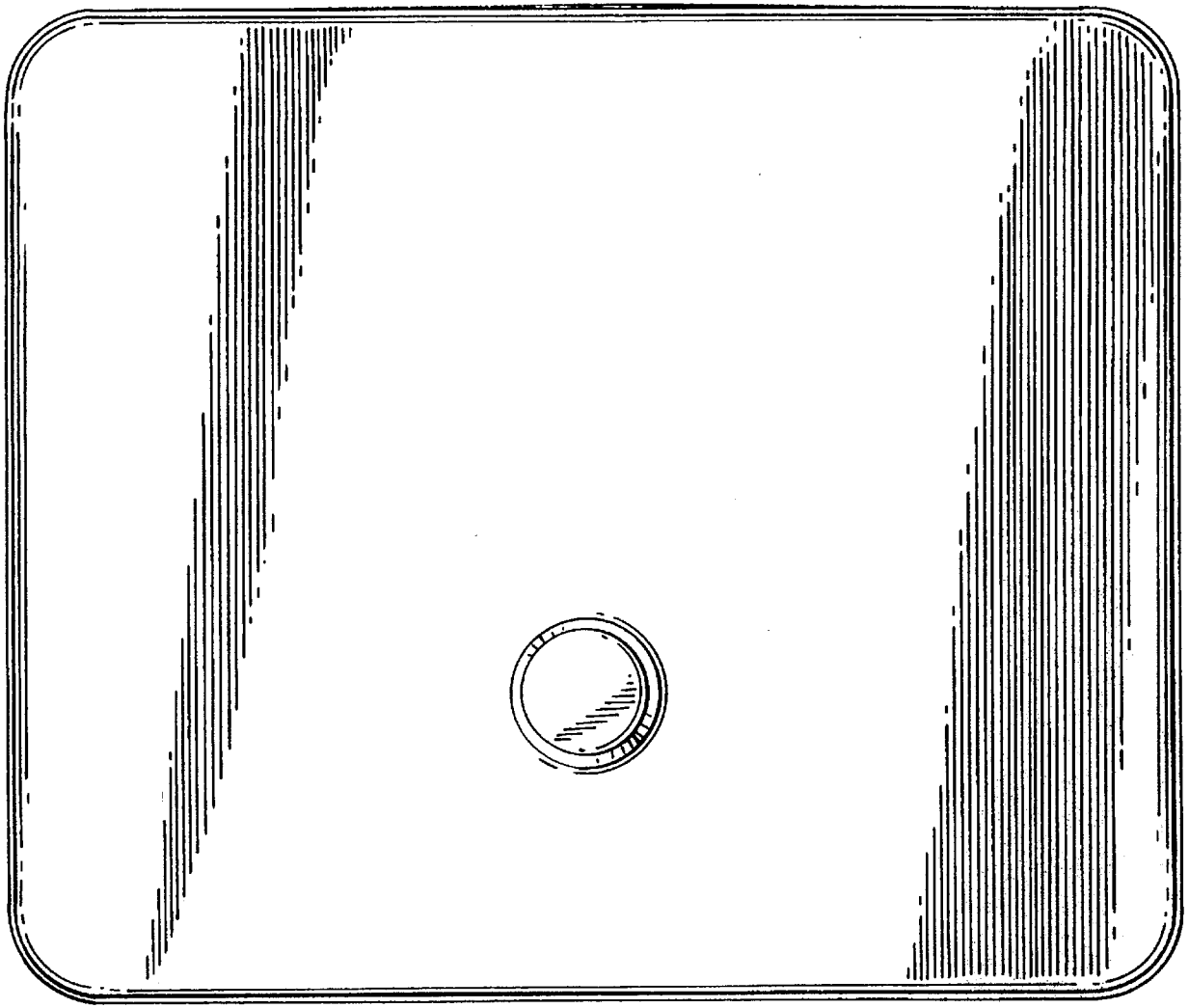
FIG. 4 is a bottom view of the container.

Referring now to the drawings, a container 10 constructed in accordance with this invention includes a body 12 having a rectangular sidewalls 14, a top 16 and sloping bottom 18. Body 12 is made of a plastic material and is formed by blow molding. Sidewall 14 is formed having a reduced dimension at 20. Top 16 is formed with two circular access holes 22, 24 covered by suitable closures 26, 28. Holes 22, 24 are advantageously disposed away from the longitudinal axis of the container so that it is easy to install and remove the closures, and it is easy to fill up and empty the container.

Figure 5:
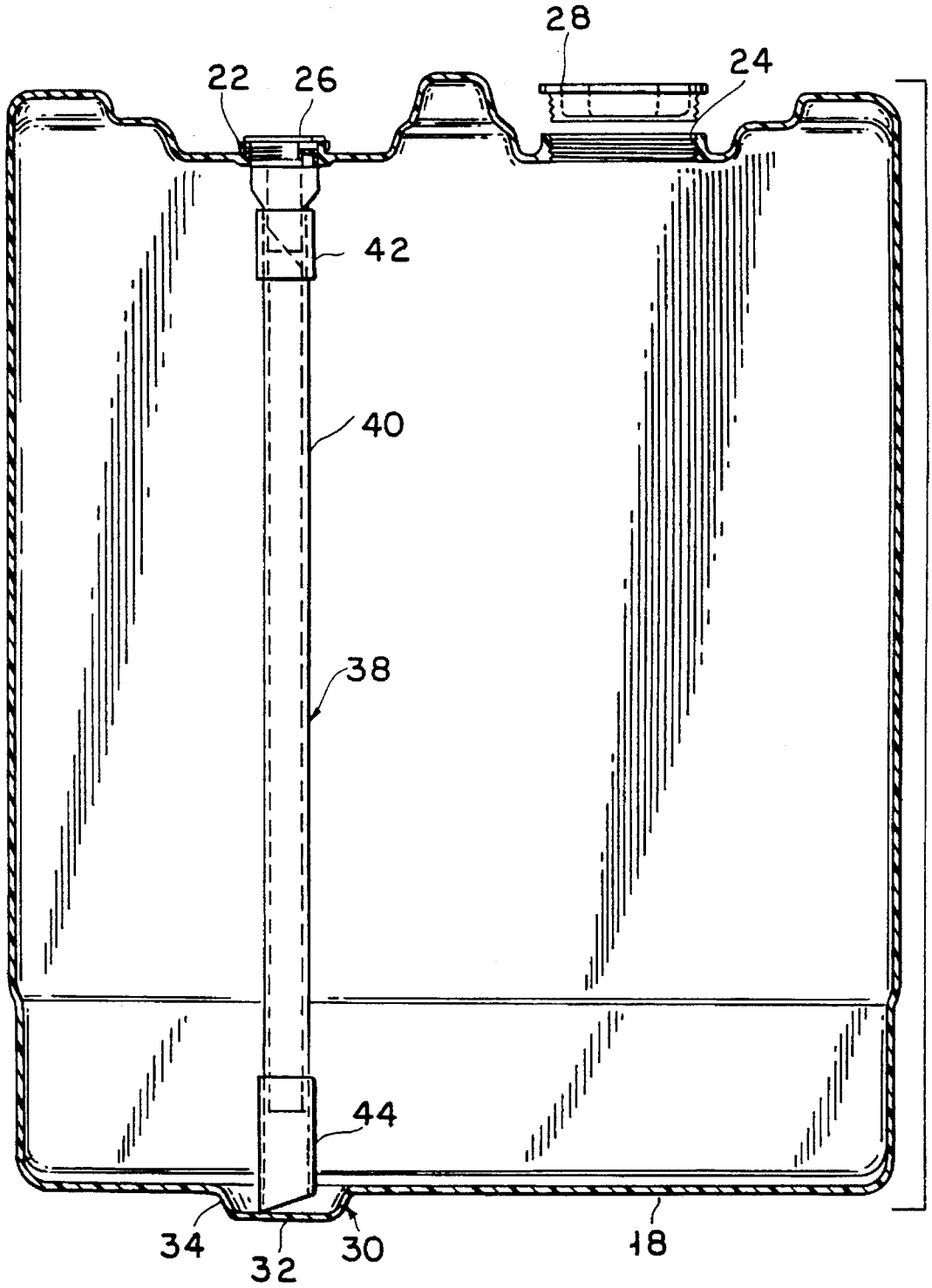
FIG. 5 is a sectional view above lines 5—5 of FIG. 3.

A sloping bottom 18 is formed with a sump 30 defined by a flat area 32 joined to the rest of the bottom by a conical wall 34. Flat area 32 is circular and has a diameter which is slightly larger than access hole 22. Importantly, area 32 is aligned vertically and coaxially with hole 24 and, as shown in FIG. 5, defines the lowest area of bottom 18. Extending between hole 22 and sump 30 is a draining pipe 38. At its top portion, draining pipe 38 is supported by access hole 24. Draining pipe 38 can be permanently installed within the container, or it may be provided separately, and installed only prior to the dispensing of liquid therefrom. As shown in detail in FIG. 5, draining pipe 38 includes an upper section 40, a sleeve 42 coupling section 40 to closure 26, and a lower stub 44. Upper section 40, sleeve 42 and stub 44 are axially movable to adjust the overall length of pipe 38. In this manner the pipe 38 can be adjusted so its length matches exactly the inner height of body 12. The stub 44 is terminated with a bottom end 46 which is formed at an angle. In this manner, the liquid from container 10 may be dispensed for example by applying suction to pipe 38, or by other means well known in the art.

At, or near, the interface between sidewall 14 and bottom there is provided a circumferential reduced diameter portion 20. This portion 20 receives a pallet 40 as shown in FIG. 9 as will be discussed more fully.

At the top 16 there is provide a plurality of raised portions or ribs 43, 45 and 47 between which are located closures 26 and 28. This serves to protect the access opening and fitting thereon. Positioned centrally with regard to the longitudinal axis of each rib are respective raised portions or bosses 48, 50, 52. These bosses are axially aligned with 48 and 52 taking on a somewhat rectangular shape, with boss 50 being circular in nature. These bosses serve to aid in the stacking of the container 10 through their engagement with respective recesses 54, 56 and 58 located in legs or extensions 60, 62 and 64 of the pallet 40. The interlocking features of the legs of the pallet and the top of the container are such that when stacked, the upper unit will not slide or slip off of the supporting tank below.

The pallet 40 also includes a plurality of other supporting legs, four legs 66 at each corner and two oppositely disposed legs 68 on either side. Disposed adjacent recess 56 is an addition recess 70 which provides a receptacle for sump 30.

Figure 8:
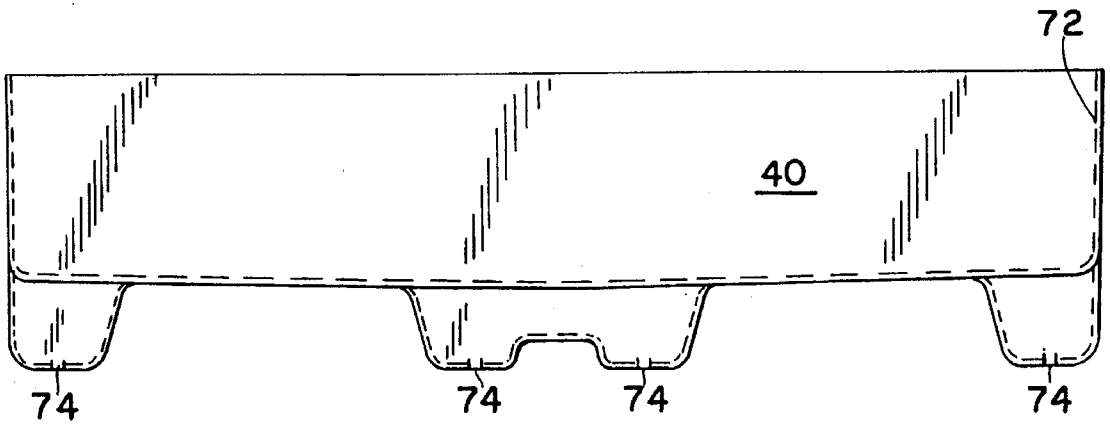
FIG. 8 is a front view of the pallet.
Figure 11:
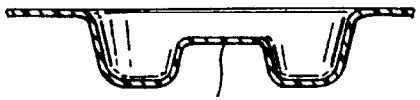
FIG. 11 is a sectional view along lines 11—11 of FIG. 10.
Figure 9:
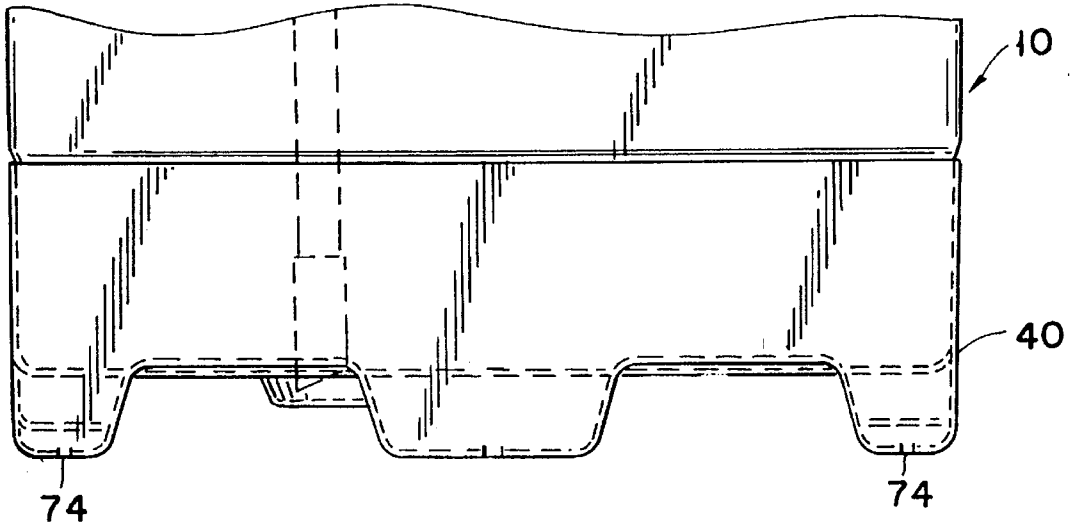
FIG. 9 is a side view of the pallet mounted on the bottom portion of the container.
Figure 10:
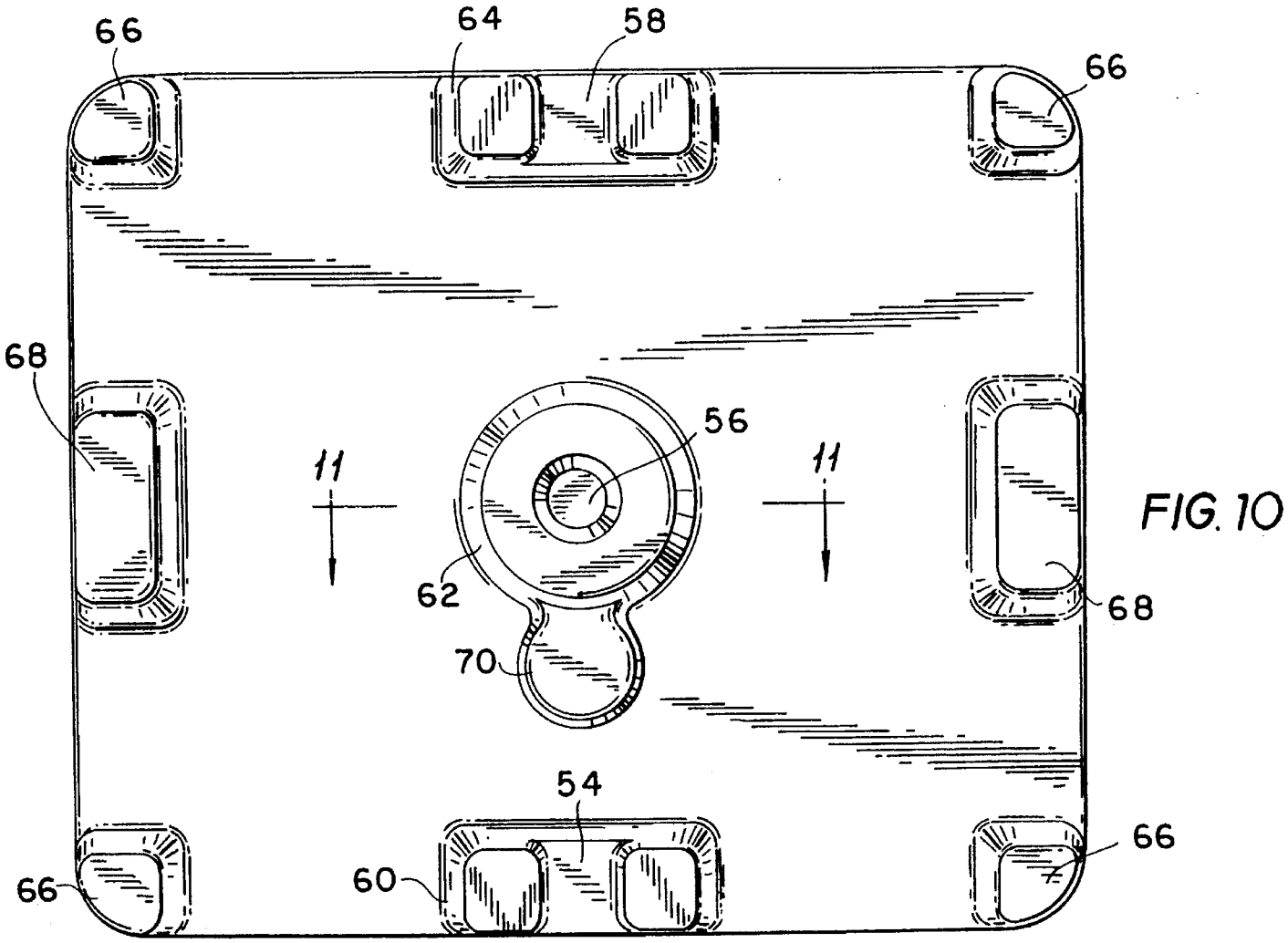
FIG. 10 is a bottom view of the pallet.

As can be seen in FIG. 9, the internal surface 72 of pallet 40 serves to interlock with the reduced dimension 20 of the side wall 14 in friction or interference fit securely coupling the pallet 40 and container 10. The side wall of the assembled tank is therefore straight. The legs of the pallet have drain holes 74. (see FIGS. 8 and 9).

The container is made by first blow-molding the body 12 to form a unitary structure and blow molding the pallet 40 separately and than applying the pallet 40 thereto. The pallet 40 may be blow molded as part of a two pallet mold and then cut in half to form two separate pallets. Pipe 38 may be inserted into the container body either before shipping, or before dispensing of the liquid.

The container 10 described is filled through one of the access holes, such as access 24. Although the other access hole 22 may also be used, access hole 24 is preferable because it permits the liquid to flow in much faster, while if hole 22 is used, the liquid flow will be impeded somewhat by pipe 38. Once the container is filled the closures are applied to seal the container 10. The container is stored or shipped as required. The liquid is dispensed, for example, by coupling drain pipe 38 to a suitable pump. Importantly, bottom 18 is sloping toward sump 30 so that surface 32 of sump 30 is the lowest surface within the container, and since the area of the sump 30 is relative small when compared to the total area of bottom 18, at the end, substantially all the liquid is the container is collected in sump 30 and may be easily removed therefrom.

Figure 6:
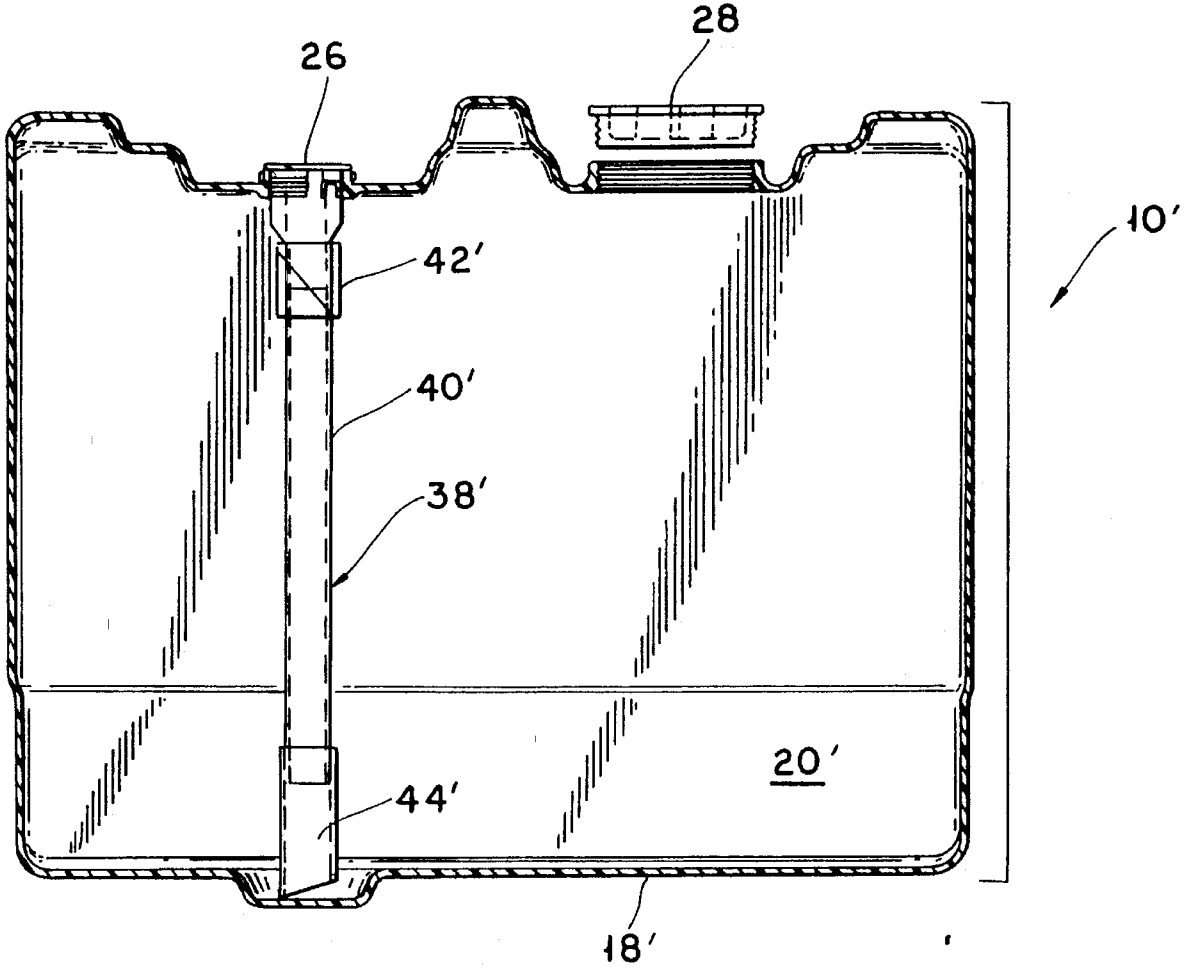
FIG. 6 is a sectional view of a second embodiment of the container.
Figure 7:
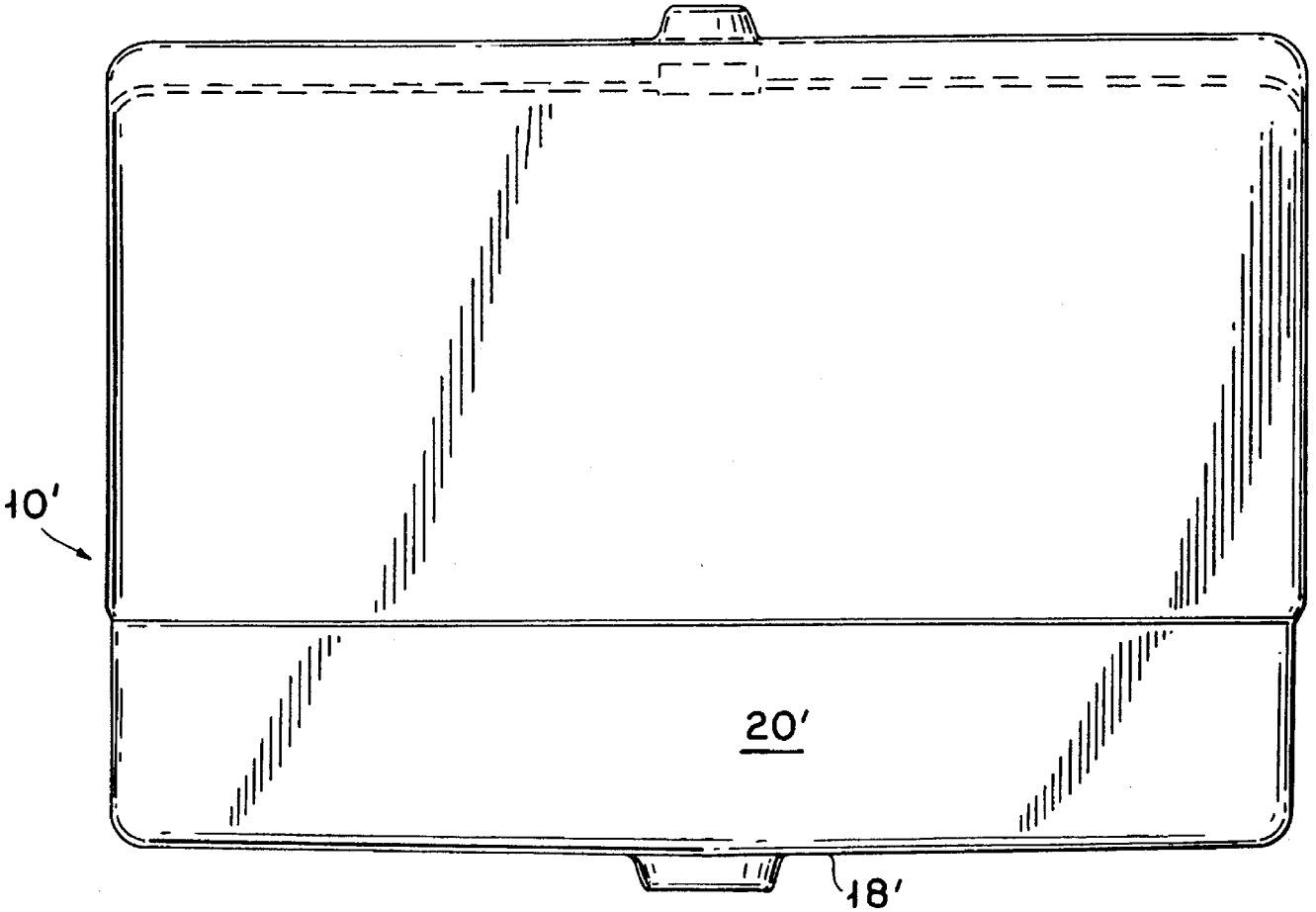
FIG. 7 is a front view of the second embodiment of the container.

With reference now to FIGS. 6 and 7, these figures depict a smaller version of the container 10' with like parts similarly marked however designated with a prime. This embodiment illustrates for example a 100 gallon container, where as the first embodiment might illustrate a 150 gallon container. As can be seen other then a shortening of the side walls, the external dimensions are the same for each so that the same size pallet may be used on both.

Note, the container and pallet may be made of similar material and thus when the use of the tank has been concluded, it can be rinsed out with the entire structure subject to recycling.

Obviously numerous modifications may be made to this invention without departing from its scope as defined in the appended claims.

What is claimed is:

1. A plastic container comprising:

a unitary plastic body having a sidewall, a top and a bottom, said top including a plurality of raised ribs, a first access hole and a second access hole being positioned between and below said ribs, and said bottom having a sump with a surface which defines the lowest surface in said body, said sump being vertically aligned with one of said first and second access hole; and a plastic pallet of integral construction separately formed from the body having an upwardly extending sidewall and secured to the bottom of the container, said pallet and container sidewalls cooperating so as to securely maintain the pallet thereto through an interference therebetween.

2. The container of claim 1 further comprising a drain pipe extending from one of said first and second access holes to said sump whereby substantially the whole contents of said container may be emptied through said drain pipe.

3. The container of claim 2 wherein said drain pipe has an adjustable length.

4. A container for storing and shipping liquid materials, said container comprising:

a unitary plastic body including a sidewall having a top and a bottom;

a plastic pallet of integral construction secured to the bottom of the container by way of an interference fit and having a plurality of recesses:

said top having a plurality of raised bosses integrally formed therewith, and further including a plurality of raised ribs, a first access hole and a second access hole being positioned between and below said ribs; and wherein upon stacking of one container upon the next, said bosses and recesses interlock so as to prevent sliding therebetween.

5. The container of claim 4 which includes a sump vertically aligned with one of said first and second access holes, said sump includes a surface which defines the lowest surface on the bottom of said body.

6. The container of claim 5 wherein said pallet includes a recess to receive said sump.

7. The container of claim 5 wherein said bottom is sloped toward said sump.

8. The container of claim 7 wherein said pallet includes at least one drain hole.

9. The container of claim 8 wherein said body and pallet are fabricated of the same material.

10. The container of claim 5 further comprising a drain pipe extending from said access hole into said sump.

11. The container of claim 10 wherein said drain pipe has an adjustable length.

12. The container of claim 4 wherein said combination of said body and pallet results in a straight sidewall.

13. A container for storing and shipping liquid materials, said container comprising:

a unitary plastic body including a sidewall; a top with a plurality of raised ribs, a first access hole and a second access hole being positioned between and below said ribs; and a sloped bottom; and a plastic pallet means of integral construction attached to said plastic body by way of an interference fit with said sidewall and arranged and constructed to maintain said body in a vertical position when resting on a flat horizontal surface.

14. A plastic container comprising:

a unitary plastic body having a sidewall, a top and bottom, said top having an access hole, and having a plurality of raised bosses, and a sump provided on and extending below the bottom and having a surface that defines the lowest surface of said body, with the bottom sloping towards the sump, said sump being vertically aligned with said access hole, said sidewall having a recessed section at the bottom; and a plastic pallet of integral construction separately formed from the body having an upwardly extending sidewall and a bottom conforming to the body bottom, the pallet sidewall engaging the recessed section of the body sidewall by way of an interference fit, with the body sidewall and pallet sidewall defining relatively straight sidewalls, the pallet bottom having a plurality of integral recesses aligned with the bosses on the body top, wherein upon stacking of said container, upon another like container, said bosses and recesses interlock so as to prevent sliding therebetween, the pallet bottom having a plurality of integral downwardly depending legs that support the container, the pallet bottom also having downwardly depending complementary surfaces that receive and protect the sump.

15. A container of claim 14 wherein the legs of the pallet have holes.

16. A plastic container comprising:

a unitary plastic body having a sidewall, a top and bottom, said top having an access hole and having a plurality of raised bosses, said sidewall having a recessed section at the body bottom;

a plastic pallet of integral construction separately formed from the body having an upwardly extending sidewall and a bottom, the pallet sidewall engaging the recessed section of the body sidewall by way of an interference fit with the body sidewall and pallet sidewall defining relatively straight sidewall, the pallet bottom having a plurality of integral recesses aligned with the bosses on the body top, wherein upon stacking of said container upon another like container, said bosses and recesses interlock so as to prevent sliding therebetween, the pallet bottom having a plurality of integral downwardly depending legs that support the container.

17. A container of claim 16 wherein the legs of the pallet have drain holes.

* * * * *